US005379966A

United States Patent [19]

Simeone et al.

[11] Patent Number: 5,379,966

[45] Date of Patent: Jan. 10, 1995

[54] WEAPON GUIDANCE SYSTEM (AER-716B)

[75] Inventors: Robert A. Simeone; Marvin C. Bean, both of Arlington, Tex.

[73] Assignee: Loral Vought Systems Corporation, Grand Prairie, Tex.

[21] Appl. No.: 825,295

[22] Filed: Feb. 3, 1986

[51] Int. Cl.[6] ..... F42B 15/00

[52] U.S. Cl. ..... 244/3.11; 244/3.13; 244/3.14

[58] Field of Search ..... 244/3.11, 3.13, 3.15, 244/3.16, 3.14, 3.19

[56] References Cited

U.S. PATENT DOCUMENTS

| | | | |
|---|---|---|---|
| 3,028,119 | 4/1962 | Coble | 244/3.11 |
| 3,073,550 | 1/1963 | Young | 244/3.11 |
| 3,820,742 | 6/1974 | Watkins | 244/3.11 |
| 4,003,659 | 1/1977 | Conard et al. | 244/3.11 |
| 4,008,869 | 2/1977 | Weiss | 244/3.13 |
| 4,097,007 | 6/1978 | Fagan et al. | 244/3.11 |
| 4,111,385 | 9/1978 | Allen | 244/3.13 |
| 4,179,088 | 12/1979 | French | 244/3.14 |
| 4,516,743 | 5/1985 | Sweeney et al. | 244/3.13 |

*Primary Examiner*—Salvatore Cangialosi
*Attorney, Agent, or Firm*—Richards, Medlock & Andrews

[57] ABSTRACT

A missile guidance system including a sensor for detecting the position of a target and for detecting the position of a missile. A fire control processor is provided that computes a trajectory for the missile to the target and is connected to the sensor to determine any variations between the actual missile position from a computed trajectory missile position. A transmitter connected to this guidance computer then provides guidance information to the missile. The guidance information includes the missile position relative to the target and enables a processor on board the missile to recompute a new trajectory to the target. This guidance information is transmitted as a single pulse during a predetermined time interval as a periodic update to the missile.

17 Claims, 5 Drawing Sheets

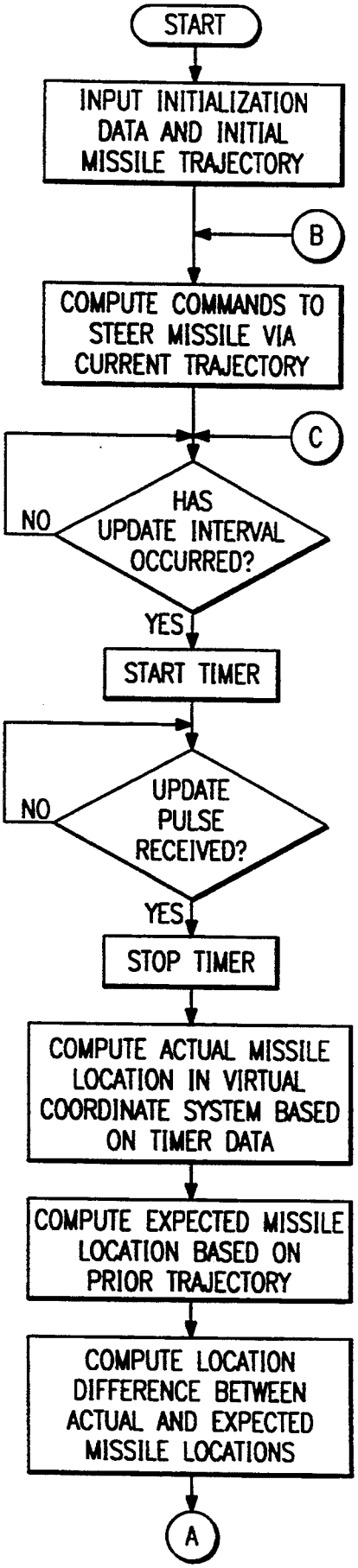
FIG. 7A
FIG. 7B
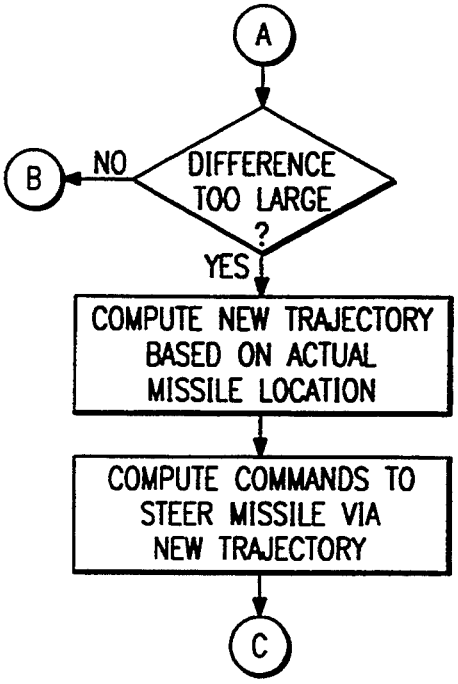

WEAPON GUIDANCE SYSTEM (AER-716B)

BACKGROUND OF THE INVENTION

1. Field of the Invention

This invention relates to a weapon guidance system and more particularly to a weapon guidance system employing beam transmission to provide guidance data.

2. Description of Related Information

Weapons guidance systems are a rather recent development. Early in warfare, weapons such as artillery and aerial bombs were initially aimed towards a target and received no further guidance after deployment. More modern weapons systems, such as guided missiles and guided bombs, use information received before initial deployment, as direction toward a target, and additional information received during weapon flight to improve the weapon's terminal accuracy.

One such system used in guided bombs and guided missiles is the "beam rider" wherein a laser beam is projected onto a target and a bomb or missile is launched in a trajectory to travel down the beam to the target. After the weapon is launched, any deviation of the weapon from the beam is corrected as required to reposition the weapon on the beam. Generally, these course corrections are of a greater magnitude than actually necessary to correct the trajectory of the weapon relative to the target since the beam is located much closer to the weapon than the target. The requirement to correct trajectory to the beam results in more stringent demands on the weapon guidance system than necessary to guide the weapon to the target.

The "beam rider" weapon guidance systems have several disadvantages in addition to requiring the guidance system to provide a greater magnitude of course correction than required to correct the weapon trajectory to the target. Another disadvantage is the requirement of maintaining the beam on the target during weapon delivery, which may be difficult because of the hostile environment of the target area. Furthermore, atmospheric conditions may not be conducive to beam transmissions over long distances, resulting in the weapon losing the beam reference before flight termination at the target. Still further, the target may detect the presence of the beam and take evasive action.

It is an object of the present invention to provide a guidance system to direct a weapon to a target in a manner adaptive to the actual trajectory of the weapon in flight relative to the target.

It is further an object of the present invention to provide a weapon guidance system that does not require continuous active target designation but which is passive relative to the target.

It is a still further object of the present invention to provide a guidance apparatus which periodically transmits signals to the weapon by which the weapon internal guidance system may determine its actual trajectory position relative to the target.

SUMMARY OF THE INVENTION

In accordance with the present invention a missile guidance system is provided that includes a sensor for determining missile position and target position. The system further includes a fire control computer for interpreting data from the sensor and controlling a beam transmitter that repetitively transmits guidance update signals to the missile during its flight. Each update signal consists of a single pulse emitted at a calculated time during a predetermined guidance update interval. The guidance information, which is provided to a guidance computer on board the missile, represents the missile's position relative to the target.

In one embodiment of this invention, a missile guidance system is provided that includes an infrared sensor for sensing objects within a field of view and specifically for detecting targets in the field of view and missiles that have been fired at the target. Tracking circuitry, connected to the sensor, provides the means for tracking the positions of the targets and the missiles. A fire control computer connected to the sensor and tracking circuitry receives sensor and tracking data for processing to provide missile position information in the form of guidance update signal pulses. The fire control computer computes the times at which guidance update intervals are to occur and the times during these guidance update intervals at which guidance update signal pulses are to be transmitted. The fire control computer directs a beam transmitter to send the guidance update pulse toward the missile during each of these predetermined guidance update intervals.

The guidance information transmitted indicates the missile's position in a plane normal to the line of sight between the sensor and the target. This position is represented by the time between the beginning of the predetermined guidance update interval and the time when the pulse is received by the missile. In this embodiment, initial guidance data is provided to a flight control computer on board the missile prior to launch. The initialization data includes relative target and missile launch coordinates and the kinematic states of the target and missile immediately prior to missile launch. The missile flight control computer then repetitively computes the missile's kinematic states and the trajectory of the missile to the target. The missile flight computer controls missile flight to terminate the missile trajectory at the target. The guidance update signals from the fire control computer and beam transmitter provide the data enabling the missile flight control computer to correct errors in calculations of missile trajectory and kinematic states.

In a further enhancement of this invention, a range receiver is included that, in combination with the beam transmitter, provides initial target range information to the fire control computer. This range information together with data from the sensor and tracking circuitry provide the initialization information input to the missile flight control computer prior to launch.

BRIEF DESCRIPTION OF THE DRAWINGS

The novel features believed characteristic of this invention are set forth in the appended claims; however, this invention can be best understood by referencing the Detailed Description of the Embodiment together with these drawings.

FIGS. 7A and 7B are flowcharts for software executed by the missile flight control computer.

DETAILED DESCRIPTION OF THE PREFERRED EMBODIMENT

This invention addresses the problem of guiding weapons to targets. In the preferred embodiment, the weapon is a hypervelocity guided missile which includes, on board, a missile flight control computer (70 in FIG. 2) for computing the missile flight trajectory to the target. The missile is launched in this embodiment by a launch vehicle, such as an aircraft, that includes a target detection sensor, a fire control computer and a laser transmitter that collectively are referred to as the fire control system.

Figure 1:
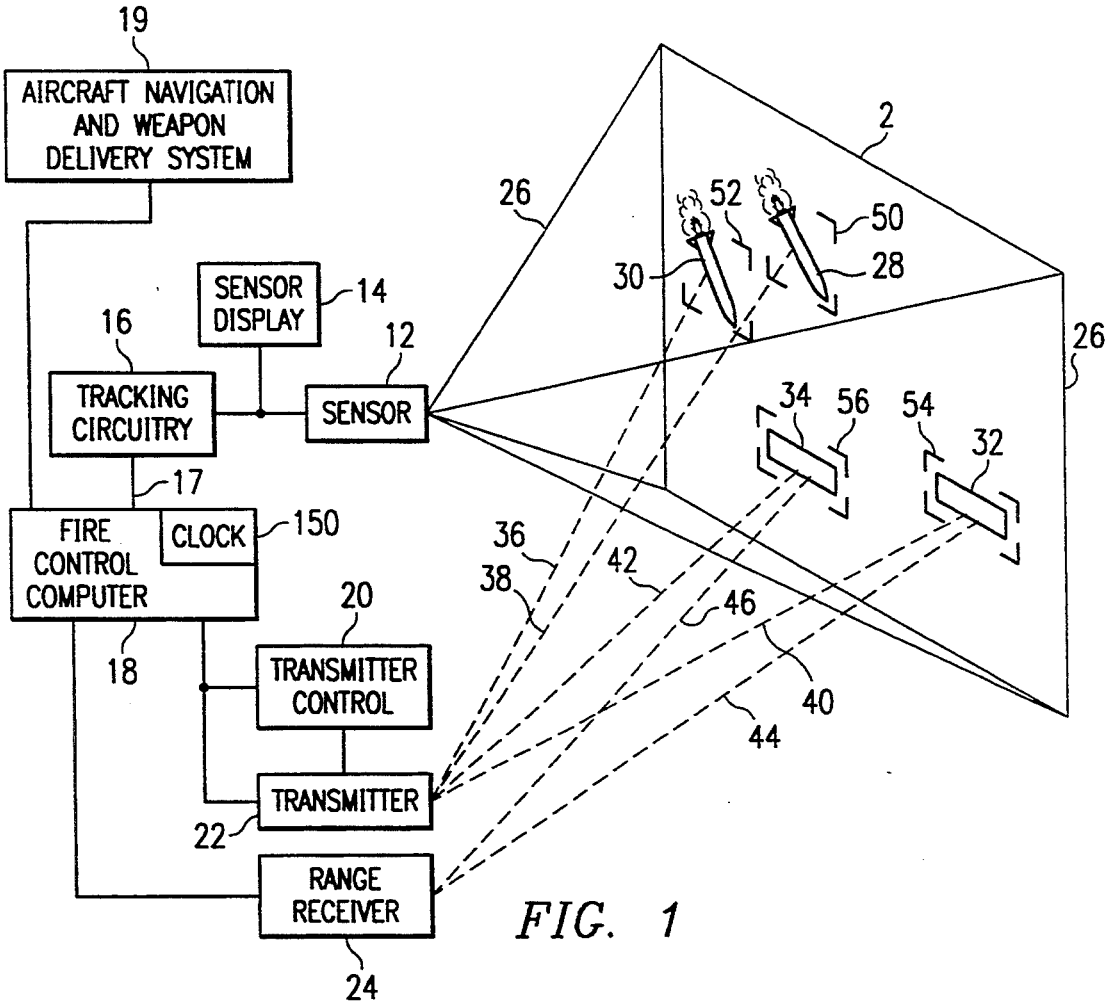
FIG. 1 is a block diagram illustrating the inventive apparatus guiding two missiles to two targets.

FIG. 1 is a block diagram functionally illustrating the fire control system. For the purposes of illustration, this embodiment includes two missiles 28 and 30 that have been launched against two targets 32 and 34 respectively. In FIG. 1, missiles 28 and 30 and targets 32 and 34 are within the field of view 26 of a sensor 12. Sensor 12 can be a television sensor, a radio frequency sensor, or an infrared sensor. In the preferred embodiment, sensor 12 is a forward looking infrared acquisition and automatic tracking sensor manufactured by Parks Jagger Aerospace, Inc. The sensor 12 is connected to a sensor video display 14 provided for operator viewing of the field of view area 26. Sensor 12 is also connected to tracking circuitry 16 for tracking the targets and missiles. This tracking capability is illustrated as target tracking gates 54 and 56, and missile tracking gates 50 and 52. The output of tracking circuitry 16 is input to a fire control computer 18. In the preferred embodiment, the forward looking infrared acquisition and automatic tracking sensor system provides a composite video signal to the sensor video display 14 and continuously provides tracking data as serial digital data to the fire control computer 18, on lines 17. The composite video signal, in the preferred embodiment, conforms to the EIA RS 170 standard. In this preferred embodiment, the video monitor is a model CD-90 video monitor manufactured by Ball Corporation Electronics Division. It should be appreciated by those skilled in the art that any commercially available video display monitor compatible with the EIA RS 170 standard may be used as sensor display 14. The digital tracking data input to the fire control computer 18 represents the pixel address of the target and missile locations in the sensor 12 field of view 26. In this embodiment, this location data includes two digital words for each position, representing elevation and azimuth information.

The fire control computer 18 computes the coordinates of the missiles 28 and 30 from the tracking data. In the preferred embodiment, the fire control computer 18 is a Motorola 68010 microprocessor with 128K of random access memory. In this embodiment the microprocessor includes a serial data interface for receiving the tracking data from the tracking circuitry 16 and is further connected to receive aircraft systems information from the aircraft navigation and weapon delivery system 19 to provide data for the initial computation of missile trajectory to the target. The fire control computer 18 provides the initialization trajectory data to a flight control computer on board each missile (computer 70 in FIG. 2). In this embodiment, the missile flight computer 70 is also a Motorola 68010 microprocessor with 128K of random access memory. Both the fire control computer 18 and the missile computer 70 each include internal clocks 150 and 151 respectively that are synchronized prior to missile launch.

The fire control computer 18 also provides output signals to a beam transmitter control 20 that directs a beam of electromagnetic radiation from a beam transmitter 22. It should be appreciated by those skilled in the art that the beam transmitter 22 can transmit electromagnetic radiation at any selected wavelength or band of wavelengths in the visual spectrum, the infrared spectrum or the radio frequency spectrum as may be appropriate to the application. In this preferred embodiment, the beam transmitter 22 is a pulsed $CO_2$ Transverse Excited Atmospheric Laser Model T250 manufactured by Marconi Avionics. This laser provides a laser pulse on command from the fire control computer 18. In this embodiment, the laser beam transmitter 22 provides feedback data to the fire control computer 18 confirming that the laser beam has been transmitted. The fire control computer 18 also provides azimuth and elevation data to the beam transmitter control 20 to direct the laser. The beam transmitter control 20 also provides orientation data as feedback to the fire control computer 18. In this embodiment, the beam transmitter control 20 includes two orthogonally mounted mirrors controlled by servomotors to direct the beam. One suitable, commercially available unit is Model G-300 PDT, manufactured by General Scanning Incorporated.

Further in the illustrated embodiment, the fire control computer 18 is connected to a range receiver 24. In this embodiment, the range receiver 24 is a Marconi Avionics $CO_2$ Laser Range Finder that provides an indication to the fire control computer 18 that the laser pulse reflected from the target has been received. The fire control computer 18 then computes the range from the length of time required for the pulse to be returned. The ranging process will be later described in more detail.

Figure 2:
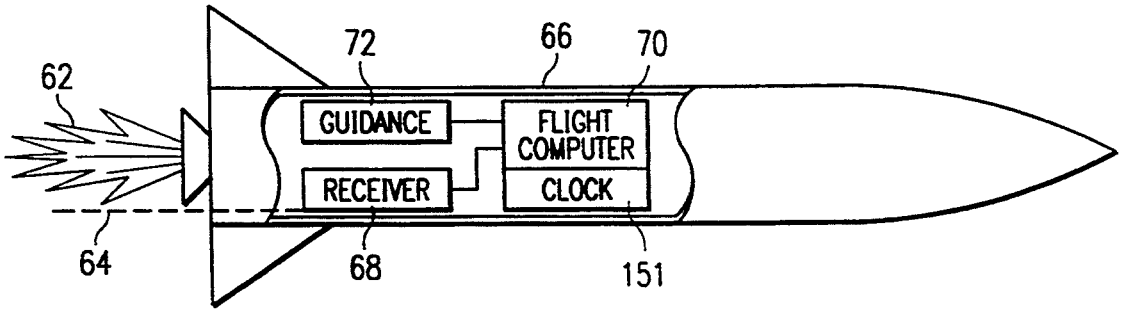
FIG. 2 is an illustration of a missile including the receiver, flight computer and guidance control system.

FIG. 2 illustrates a partial cut-away view of a missile 66 containing a beam receiver 68 connected to a missile flight control computer 70 which is connected to a missile flight guidance controller 72. The receiver 68 is mounted on the missile 66 and aimed in a direction to receive the beam 64 from the beam transmitter 22 (FIG. 1). In the preferred embodiment, receiver 68 is mounted on the aft end of the missile to receive the beam 64 which may pass through the rocket plume 62, depending on the specific orientation of the missile 66. This receiver 68 is defined in detail in the copending patent application entitled "On Board Receiver", Ser. No. 825,121, filed Feb. 3, 1986 and abandoned in favor of continuation application Ser. No. 07/127,547, now U.S. Pat. No. 4,761,556. The guidance information received by receiver 68 is input to the missile flight control computer 70 which provides the appropriate attitude correction signals to the missile flight guidance controller 72 to reorient the missile and correct the missile flight trajectory. In this manner, the flight trajectory of the missile 66 is controlled.

The operation of this preferred embodiment of the invention will now be described. In FIG. 1, the sensor 12 is directed to include a field of view 26 that further includes an area that can be illuminated by beams transmitted by beam transmitter 22. It should be understood by those skilled in the art that the steering of the sensor 12 field of view 26 may be coordinated with the steering of the beam transmitter 22 to ensure proper system operation. When a target is detected within this field of view 26, the sensor operator activates the tracking circuitry 16 and the target position is tracked by tracking circuitry 16. This tracking circuitry 16 performs several functions including maintaining position information of the targets and missiles with data from the sensor 12. In a further enhancement of this embodiment, the tracking circuitry 16 is used to direct the sensor field of view 26 to maintain the target in view. This enhancement is useful when motion of the sensor or target, or both, may require sensor field of view movement to follow the target, i.e. to maintain the target within the sensor field of view.

Once the targets 32 and 34 have been acquired, the positions are continuously tracked, as represented by tracking gates 54 and 56, by tracking circuitry 16 and the target position information is continuously provided as a serial digital data input to the fire control computer 18. Specifically, the serial digital data for the target position consists of one data word for target position azimuth and one data word for target position elevation in the sensor field of view.

Upon detection of the first target 32, the fire control computer 18 obtains the target range by commanding the beam transmitter control 20 to direct the beam transmitter 22 toward target 32 using the target position information previously discussed. The fire control computer 18 then commands the beam transmitter 22 to transmit beam 40 to target 32, and the resulting radiation reflected from target 32 is received by range receiver 24 as a reflected beam 44. Upon detection of the second target 32 and obtaining the second target position in the same manner discussed for the first target, the fire control computer 18 determines the second target range by commanding the beam transmitter control 20 to direct the beam transmitter 22 toward target 34 and then commanding the beam transmitter 22 to transmit beam 42 to target 34. A beam reflected from target 32 is received by range receiver 24 as reflected beam 46. The range receiver 24 provides indications that the reflected beams 44 and 46 were transmitted to the fire control computer 18 at the time of reception. This data is used by the fire control computer 18 to compute the respective target ranges based upon the time between beam transmission and beam reception.

As part of the preparation for firing the missiles, the positions of their respective targets are input into the missile's flight control computer 70 which computes the initial missile trajectory to the target. The missile flight control computers 70 and the fire control computer 18 include clocks 151 and 150 respectively that are then synchronized before missile launch. In this embodiment. synchronization is accomplished by determining the number of cycles of the missile clock 151 which occur during a predetermined time interval generated by the fire control clock 150 under the control of the fire control computer 18. After the missiles are launched, the fire control computer 18 estimates the time and location at which the missiles will each enter the field of view 26. After each missile enters the field of view 26 the tracking circuitry 16 begins to provide missile position data to the fire control computer 18.

Before a predetermined first time interval, the fire control computer 18 commands the beam transmitter control 20 to aim the beam transmitter 22 toward missile 30 and then, at a previously computed time, commands beam transmitter 22 to transmit a guidance update pulse 36 to missile 30. In a similar sequence before a second predetermined time interval, the fire control computer 18 commands the beam transmitter control 20 to direct the beam transmitter 22 toward missile 28 and then, at a previously computed time, commands the beam transmitter 22 to transmit a second guidance update pulse 38 to missile 28. This sequence is repeated at appropriate predetermined intervals throughout the flight of the missiles 28 and 30. After reception of this information, the missile flight control computers (such as computer 70) determine if the missiles are on course and, if not, the flight computer will generate missile attitude commands to redirect the respective missiles to their targets based upon the updated guidance information. This repetitive update and correction procedure continues for the flight of the missile to the target.

Figure 3A:
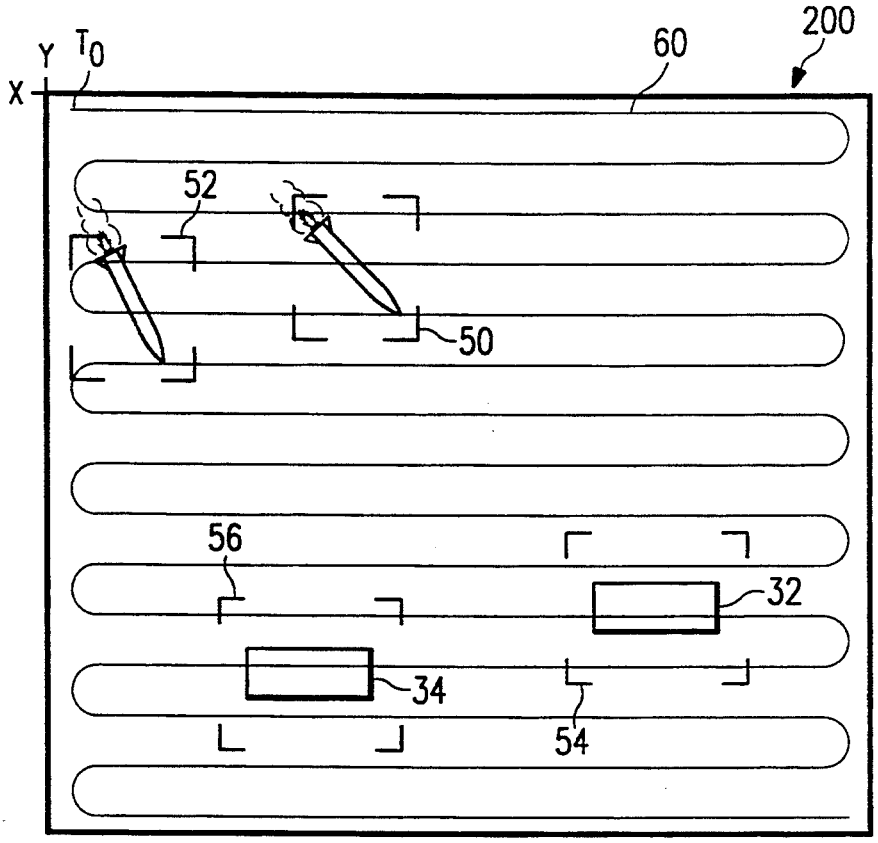
FIGS. 3A and 3B are illustrations of the computer virtual coordinate system.

The guidance update information will now be described. When the fire control computer 18 receives the target position information from sensor 12 and tracking circuitry 16, it computes a virtual coordinate system 200 that is illustrated in FIG. 3A. The target is always located at a predetermined reference point (such as illustrated by target 32 for missile 28 in FIG. 3B) in this computed virtual coordinate system 200. When the fire control computer 18 receives the position of the missile from the sensor 12 and tracking circuitry 16, the computer 18 also computes the position of the missile in the virtual coordinate system 200 as is illustrated by missile 28 in FIG. 3B.

Figure 3B:
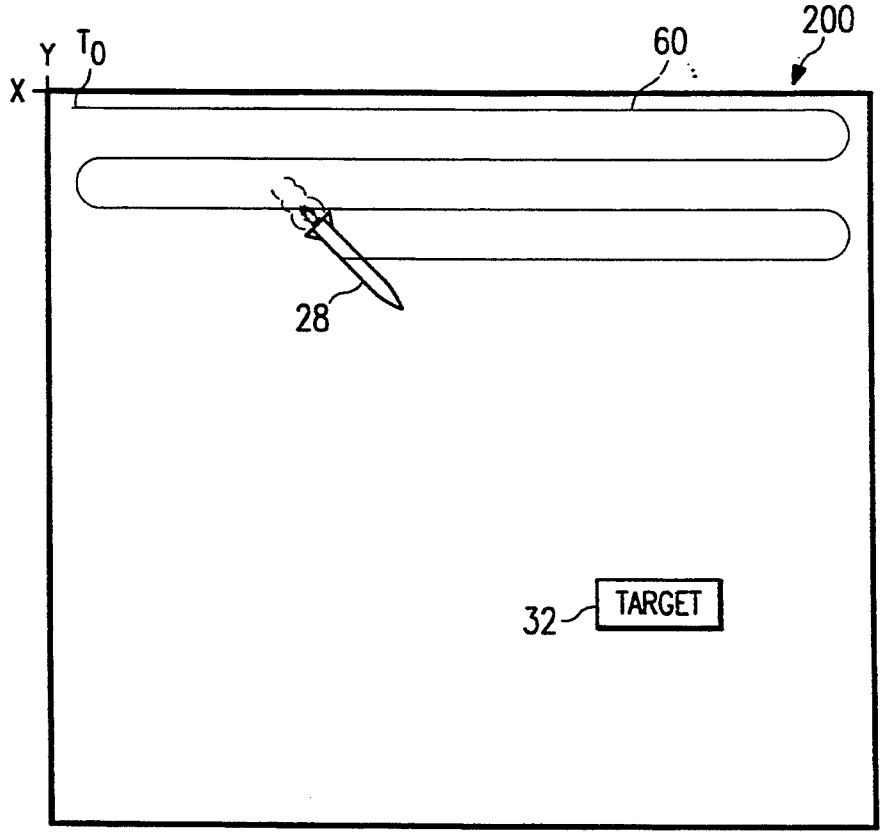

The fire control computer 18 then computes a virtual raster scan line 60 that computationally scans at a predetermined rate across the virtual coordinate system 200 as illustrated in FIGS. 3A and 3B. This scan line 60 always begins at the origin of the coordinate system $T_0$ and continues to scan until the missile position within the virtual coordinate system 200 is designated, i.e. position of missile 28 in FIG. 3B. This identical computational exercise for formulating the virtual coordinate system 200 is also being performed in the missile flight control computer 70. Since the target position in the virtual coordinate system 200 is fixed, i.e. predefined in both the computers 18 and 70, the only information lacking in the missile flight control computer 70 is the actual location of the missile relative to the target. This position information is the time of the scan line. 60 to scan from $T_0$ to the missile position at this predetermined scan rate thus designating the missile position and is the information that is transmitted by beam transmitter 22 to the missile.

The interpretation of this guidance update information will now be discussed. The clocks 150 and 151 located in the fire control computer 18 and the missile flight control computer 70 respectively are synchronized and are used by the software on board each computer to indicate the predetermined guidance update time intervals for receiving the missile positional information. The information received during these time intervals represents the time that the computed virtual raster scan line 60 takes to scan from the virtual coordinate system 200 origin $T_0$ to the actual location of the missile, such as 28, in the virtual coordinate system 200. This scan time is presented to the missile as the time between the beginning of the guidance update time interval to the time that the pulse transmission from beam transmitter 22 is received. Then the missile flight control computer 70 has the same information that the fire control computer 18 contains as to the missile's position. The missile flight control computer 70 then compares the actual position of missile 28 with an expected missile position based upon a previously computed trajectory and determines if a variation exists and, if a variation does exist, whether the variation is of a magnitude that requires recomputation of a new missile trajectory to the target.

Figure 4:
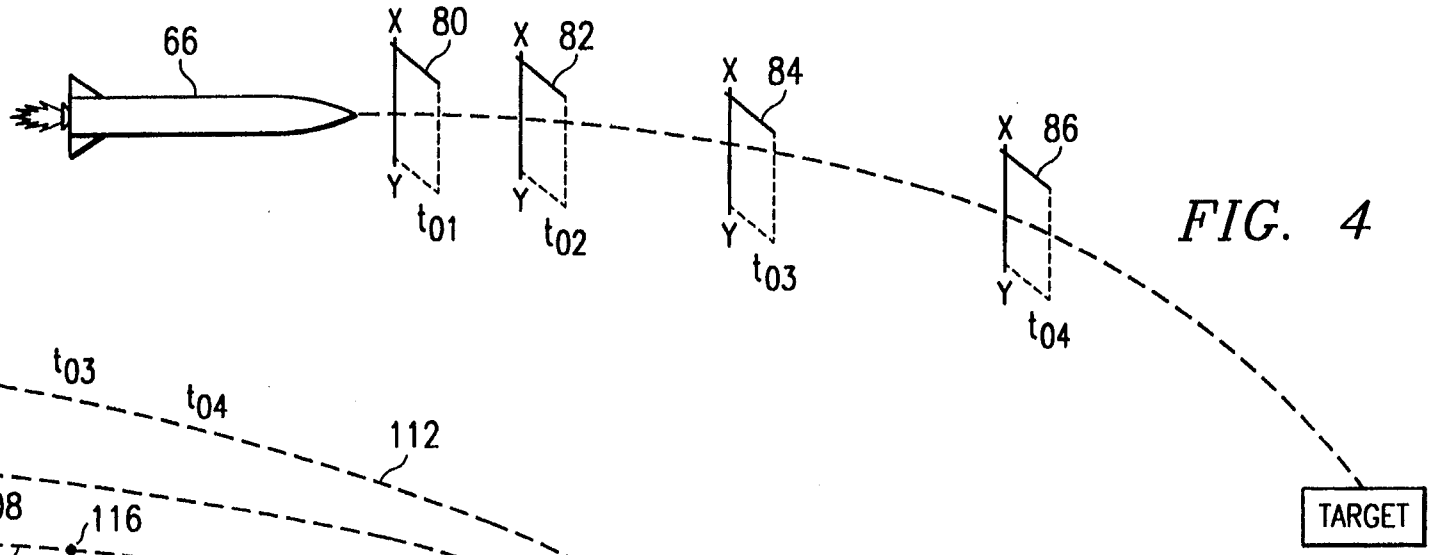
FIG. 4 is an illustration of the timing of the missile guidance updates.

FIG. 4 illustrates the periodic update of guidance information as the missile travels to the target. These updates occur at time intervals or time frames 80, 82, 84 and 86 represented for discussion as four time periods $t_{01}$, $t_{02}$, $t_{03}$ and $t_{04}$. During each of these time frames 80, 82, 84 and 86, the missile flight control computer 70 receives an indication from the beam receiver 68 that a pulse has been received wherein the time between the beginning of the time interval and the time that the pulse is received represents the time for the virtual raster scan line 60 of FIG. 3B to scan, locating the actual position of the missile in the computed virtual coordinate system 200 within missile flight control computer 70. If the difference between the predicted position and the actual missile position is of a magnitude greater than a prescribed variation, the flight control computer 70 computes a new missile trajectory to the target with standard trajectory algorithms resident in the missile flight control computer 70. These computations are repeated, if required, at each of the time frames 80, 82, 84, and 86 by the missile flight control computer 70 in response to the guidance update signals received from the transmitter 22 by means of the missile receiver 68.

Figure 5:
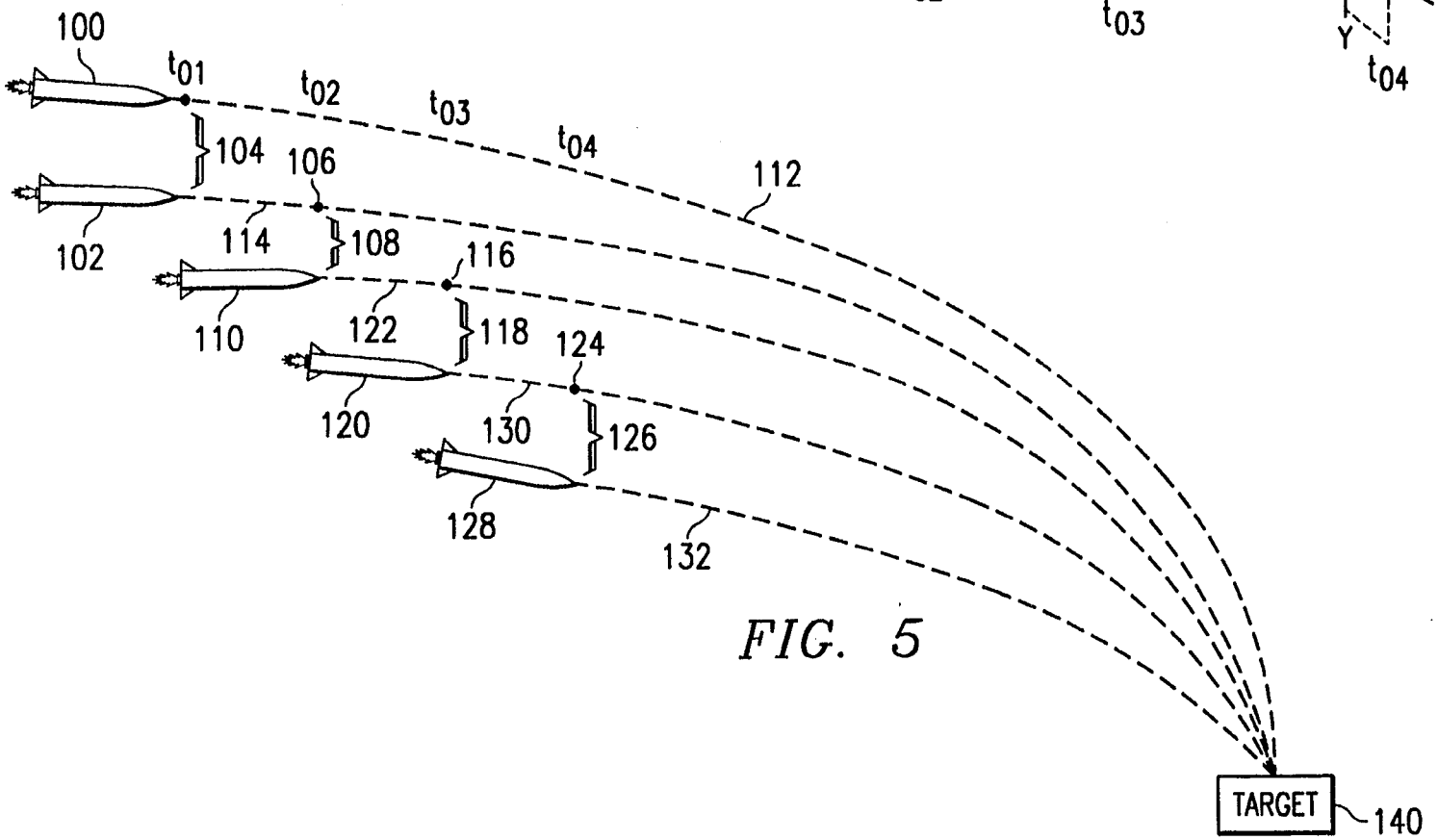
FIG. 5 is an illustration of adaptive missile trajectories which occur in the operation of the invention.

A series of corrected trajectories computed by the missile flight control computer 70 based on the information received by the missile receiver 68 from the beam transmitter 22 is illustrated in FIG. 5. As previously discussed, the information consists of a pulse transmission that occurs at a time after the periodic update reference time $T_{0n}$ where n is the time interval number. In other words, since the missile flight control computer clock 151 is synchronized with the fire control computer clock 150, both the missile flight control computer 70 and the fire control computer 18 include simultaneously occurring periodic update reference time intervals $T_{0n}$ enabling the relative position of the missile to the target to be transmitted as guidance information to the missile receiver 68 as a single pulse during these synchronized periodic update reference time intervals. The single pulse is interpreted by the missile flight control computer 70 to represent the relative position of the missile with respect to the target interpreted, as previously discussed, being the time between the period reference beginning $T_{0n}$ and the time that the pulse is received from the beam transmitter 22 for each time period n. Also as previously described, this time represents the time $T_m$ between the beginning of the virtual raster scan at the origin, $T_0$, of the virtual coordinate system 200 of FIG. 3B to the time that the virtual raster scan 60 intersects the missile position. Upon determining $T_m$ the synchronized flight control computer 70 on the missile may then, if required, compute a new trajectory to the target based on this current position information.

Referring to FIG. 5, initially a trajectory 112 is computed before launch of the missile. When the first time reference point $T_{01}$ occurs, the actual missile location 102 is determined from the reception of the guidance update pulse as previously discussed. The reception of the pulse is indicated by the missile receiver as occurring some time, $T_m$, after the reference time $T_{01}$, and the on board missile flight control computer 70 computes a new trajectory 114 if the difference in trajectory position 104 between the actual missile position 102 and the computed or expected missile position 100 is greater than a predetermined magnitude. At the next reference time $T_{02}$ the actual position 110 of the missile again is compared with a previous trajectory computed position 106 resulting in a new computed trajectory position difference 108, which is used to recompute the trajectory 122 if required. Likewise, during interval $T_{03}$ the computed previous trajectory position 116 is compared to the actual position 120 to determine the difference 118 for computing the new trajectory 130. This procedure is again repeated for $T_{04}$ resulting in the computed previous trajectory position 124 being compared to the actual position 128 for computing the position difference 126, which is used to determine if the missile flight control computer 70 is to compute the new trajectory 132. As a result of the computation of each new trajectory of this example, the flight control computer 70 on board the missile provides new data to the guidance controller 72 to steer the missile to each new trajectory.

Figure 6A:
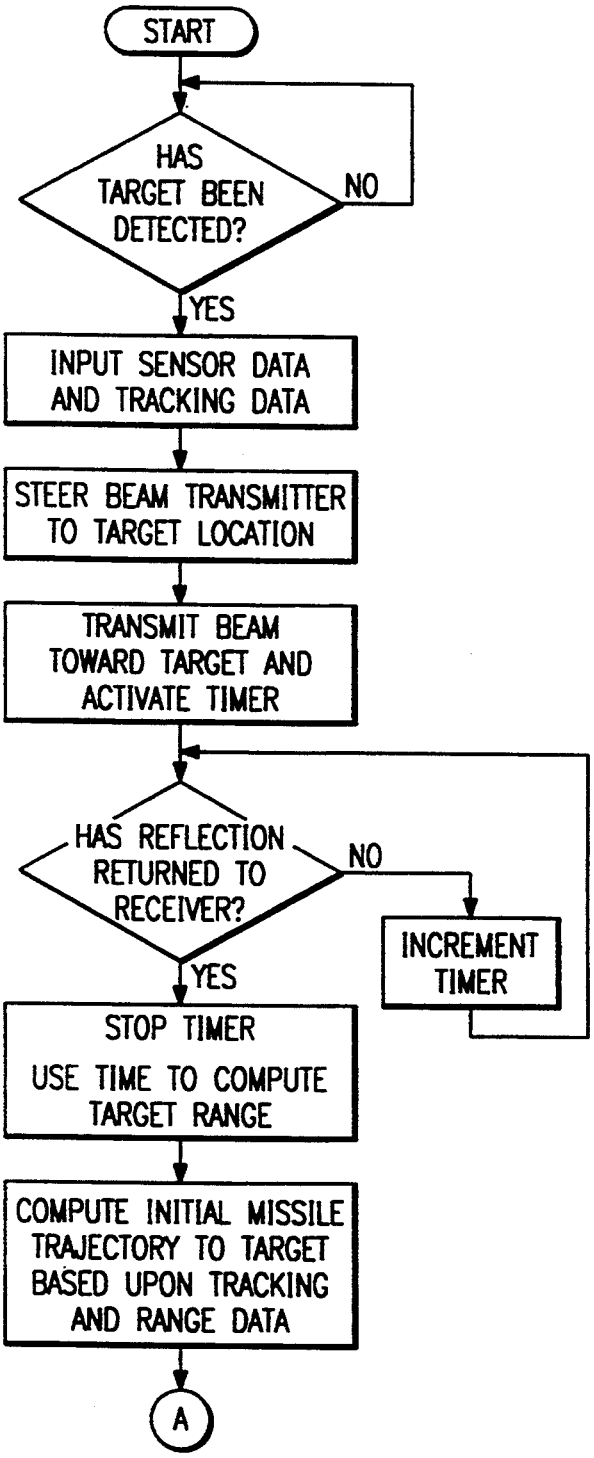
FIGS. 6A and 6B are flowcharts for software executed by the fire control computer.
Figure 6B:
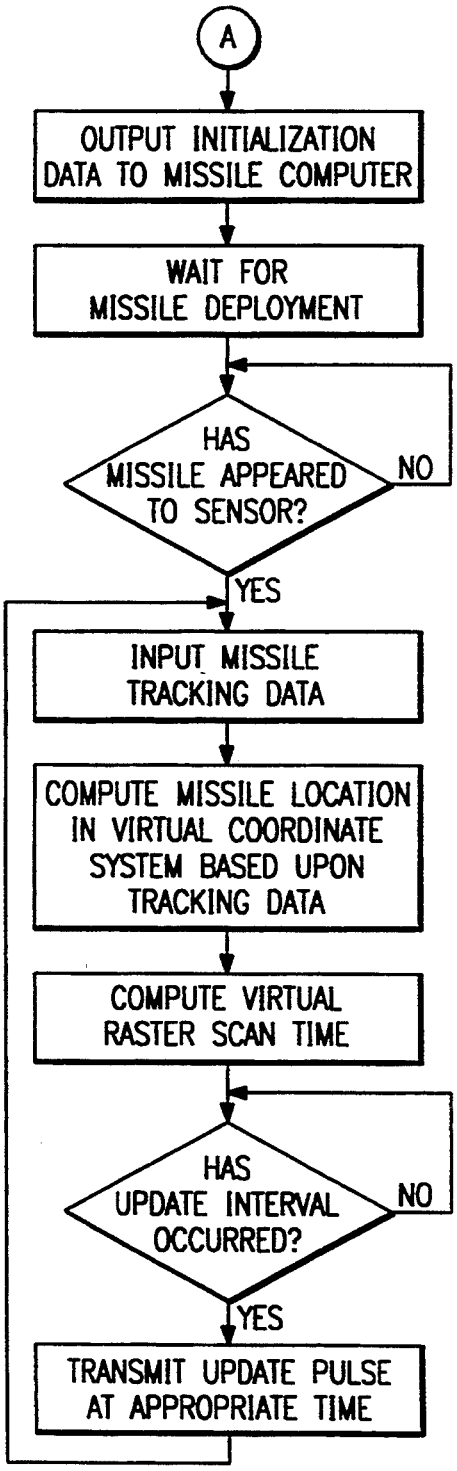

FIGS. 6A and 6B constitute a software functional flowchart that illustrates software to be executed by the fire control computer 18. Initially, the software enters a wait state waiting for the detection of a target. This detection is indicated to the fire control computer 18 by an input from the tracking circuitry on lines 17 as previously discussed. The sensor data and tracking data are input to the fire control computer 18 so that the virtual coordinate system may be computed locating the target in the predetermined location. The fire control computer 18 provides a command to the beam transmitter control 20 to steer the beam transmitter 22 to the target location. A command is then transmitted to the beam transmitter 22 so that a beam is transmitted towards the target and at the same time a timer in the fire control computer 18 is activated. Fire control computer 18 enters a loop until an indication from the range receiver 24 indicates receiving the reflected beam. The timer is stopped and this elapsed time is used to compute the target range. The fire control computer 18 uses the sensor data and tracking together with the range data to initiate the missile computer by providing the initial missile trajectory and other initialization data to the missile computer 70. Fire control computer 18 enters a wait state, waiting for missile deployment. After the missile has been deployed, the fire control computer 18 waits for the missile to appear in the sensor field of view. Upon the missile entering the field of view, the fire control computer inputs the tracking data from tracking circuitry 16 to compute the missile location in the virtual coordinate system. After the missile has been located in the virtual coordinate system, the fire control computer 18 then computes the virtual raster scan time. Upon the occurrence of an update interval, this raster scan time then is used to determine when the beam transmitter 22 transmits the guidance update pulse to the missile as previously described. After the pulse has been transmitted, the fire control computer then uses updated tracking data to recompute the missile location in the virtual coordinate system.

FIGS. 7A and 7B constitute a functional flowchart for the software that is executed in the missile flight control computer 70. Upon start-up, the missile flight control computer 70 is initialized by the fire control computer 18 as previously discussed. This initialization includes the input of the initial missile trajectory. The missile flight control computer 70 then computes the commands required to steer the missile in accordance with this initial missile trajectory. The missile flight control computer 70 continuously generates these commands in accordance with this trajectory until a new trajectory is computed as a result of guidance information received during an update interval. Upon the occurrence of an update interval, the missile flight control computer 70 starts a timer and waits for the update pulse to be received. When this update pulse is received, the timer is halted and the elapsed time is used by the missile flight control computer 70 to locate the missile's position in a virtual coordinate system as previously explained. It should be understood that this virtual coordinate system is identical to the virtual coordinate system computed by the fire control computer 18. Since the target position in this virtual coordinate system is predetermined, the location of the missile by the virtual raster scan time provides the missile flight control computer 70 with the information required to update the missile trajectory computations. The missile flight control computer 70 then computes the missile's expected location based on a prior trajectory and then compares this expected missile location with the actual missile location based upon the timer data from the received update pulse. The magnitude of this difference is used by the missile flight control computer 70 to decide whether or not to compute a new trajectory. If this difference is too large, a new trajectory is computed based upon the missiles actual location in the virtual coordinate system relative to the target position in the virtual coordinate system. Upon computing this new trajectory, new commands are provided to steer the missile via this new trajectory. If the difference between the actual missile location and the expected missile location are not too large, the missile flight control computer 70 continues to compute steering commands for guiding the missile in accordance to the previous trajectory. In any event, the missile flight control computer then waits until the next update interval occurs and then repeats the updating process. This software sequence is continued for the flight of the missile.

Referring to FIG. 5, it is important to understand that the recomputed trajectory is not a trajectory which controls the missile in such a manner as to return the missile to the initial trajectory 112 but rather results in a new missile trajectory to the target 140, if required, upon the reception of each guidance update pulse. This is a difference from the prior art and results in a smoother guidance control transition in correcting a missile flight to the target.

Another important feature of this invention is that the guidance system is totally passive in relation to the target after the initial target range has been determined, and, since the communications link between the guidance beam transmitter 22 (FIG. 1) and the missile 28 or 30 is by line of sight, it is difficult if not impossible for the target to take countermeasures to jam this communications link.

Although preferred embodiments have been described in detail, it should be understood that various substitutions, alternations and changes may become apparent to those skilled in the art. These modifications may be made without departing from the scope and spirit of the invention as defined by the appended claims.

What is claimed is:

1. A missile guidance system comprising:

sensor means for detecting and tracking at least one target and for detecting and determining the position of at least one missile, the thus determined position for each missile being relative to the target at which the missile was fired;

fire control processing means for computing trajectories for each missile to its target, and for determining any variation of an actual position of the respective missile from a computed trajectory position for that missile;

transmitter means for providing guidance information to each of the missiles, the guidance information being in the form of single pulses each occurring at calculated times during predetermined guidance update intervals; and flight control processing means aboard each missile, responsive to said guidance information for the respective missile for determining the time between the beginning of a predetermined guidance update interval and the time at which the pulse representing guidance information for the respective missile is received by that missile and for computing an updated trajectory for the respective missile in response to said guidance information for the respective missile.

2. A missile guidance system according to claim 1, wherein said actual position of a missile is represented in the guidance information transmitter to that missile as the time between the beginning of the predetermined guidance update interval and the time at which the pulse representing guidance information is received by that missile.

3. A missile guidance system according to claim 2, wherein said fire control processing means comprises a first clock, and wherein said flight control processing means comprises means for computing the missile's trajectory and a second clock which is in synchronism with said first clock included in the fire control processing means.

4. A missile guidance system comprising:

a beam transmitter means for emitting an electromagnetic radiation beam in a beam area;

a sensor means for sensing a field of view that includes the beam area and for detecting targets therein and for determining positions of missiles fired at the targets;

tracking means connected to said sensor means for directing the sensor field of view to maintain the targets within the field of view;

fire control processing means for computing and providing guidance information to each missile during its flight, connected to the tracking means for computing an actual position of each missile during its flight and for providing targeting information to each missile prior to its flight, and connected to the beam transmitter means for commanding beam transmission so that guidance information is included in a beam in the form of a pulse within a predetermined guidance update interval;

beam transmitter control means for directing to each respective one of the missiles a beam containing the guidance information for the respective missile;

missile beam receiver means in each missile for receiving the beam directed to that missile; and missile flight control processing means aboard each missile for determining the time elapsing between the beginning of each predetermined guidance update interval in the beam directed to that missile and the time at which the pulse is received by that missile and for interpreting the thus elapsed time to compute the actual position of that missile and for computing a new missile trajectory to the target of that missile if the actual position of that missile varies by greater than a predetermined factor from a previously computed trajectory missile position for that missile and for controlling the flight of that missile in accordance with the current computed missile trajectory for that missile.

5. A missile guidance system according to claim 4 wherein the guidance information includes a missile's position relative to its target.

6. A missile guidance system according to claim 5 wherein said actual position of a missile is represented in the guidance information for that missile as the time between the beginning of the predetermined guidance update interval and the time at which the pulse is received by that missile.

7. A missile guidance system according to claim 6 wherein each missile flight control processing means includes a first clock which is in synchronism with a second clock which is included in the fire control processing means.

8. A missile guidance system according to claim 7 wherein the beam transmitter means transmits a beam to a target to determine range to that target.

9. A missile guidance system according to claim 8 wherein the fire control processing means comprises means for computing a virtual coordinate system including position of one missile and one target position wherein the target position is a constant reference position within the virtual coordinate system.

10. A missile guidance system according to claim 9 wherein a missile position within the virtual coordinate system is determined by a virtual raster that computationally scans the virtual coordinate system from a fixed origin until that missile's position in the virtual coordinate system is scanned.

11. A missile guidance system comprising:

beam transmitter means for transmitting a beam of electromagnetic radiation in an area;

sensor means for detecting targets and missiles in the area;

a range means for determining the range to the targets when the targets are detected;

tracking means connected to the sensor means for tracking the target positions;

at least one missile including a beam receiver, a missile processing means for computing a trajectory for that missile to one of the targets, and missile control means for controlling missile flight direction;

fire control processing means connected to the sensor means for determining actual missile positions, for computing guidance information, for providing targeting information to each missile prior to its flight, and for commanding the beam transmitter means to transmit the beam at a computed time in accordance with the computed guidance information; and beam transmitter control means connected to the fire control processing means for directing the beam transmitter means to provide the guidance information to a missile's beam receiver, the guidance information being in the form of single beam pulses each transmitted during predetermined guidance update intervals, the time elapsing between the beginning of each predetermined guidance update interval and the time the respective single beam pulse is transmitted corresponding to the position of the respective missile in a raster scanned image of the respective missile and its target.

12. A missile guidance system according to claim 11 wherein the guidance information includes each missile's actual position relative to its target.

13. A missile guidance system according to claim 12 wherein said actual position of a missile is represented in the guidance information as the time between the beginning of the predetermined guidance update interval and when the pulse is received by that missile.

14. A missile guidance system according to claim 13 wherein a missile's beam receiver receives the guidance information from the beam transmitter means and the guidance information is used by the missile processing means to compute updated trajectories for the respective missile to its target, the updated trajectories providing guidance commands to the missile control means.

15. A missile guidance system according to claim 14 wherein the fire control processing means comprises means for computing a virtual coordinate system including position of one missile and one target position wherein the target position is at a constant reference position within the virtual coordinate system.

16. A missile guidance system according to claim 15 wherein a missile position within the virtual coordinate system is determined by a virtual raster that computationally scans the virtual coordinate system from a fixed origin until that missile's position in the virtual coordinate system is scanned.

17. A missile guidance system according to claim 16 wherein said actual position represented in the guidance information is a scan time from an origin of the virtual coordinate system to the actual missile's position within the virtual coordinate system.

* * * * *